US012426714B2

(12) United States Patent
Li

(10) Patent No.: US 12,426,714 B2
(45) Date of Patent: Sep. 30, 2025

(54) CHAIR WITH ADJUSTABLE BACK DEPTH

(71) Applicant: Zhongshan Donati Co., Ltd, Zhongshan (CN)

(72) Inventor: Xijian Li, Zhongshan (CN)

(73) Assignee: Zhongshan Donati Co., Ltd, Zhongshan (CN)

( * ) Notice: Subject to any disclaimer, the term of this patent is extended or adjusted under 35 U.S.C. 154(b) by 173 days.

(21) Appl. No.: 18/379,980

(22) Filed: Oct. 13, 2023

(65) Prior Publication Data

US 2025/0040716 A1 Feb. 6, 2025

(30) Foreign Application Priority Data

Aug. 4, 2023 (CN) ..... 202310983403.1

(51) Int. Cl.
*A47C 7/44* (2006.01)

(52) U.S. Cl.
CPC ..... *A47C 7/441* (2013.01); *A47C 7/446* (2013.01)

(58) Field of Classification Search
CPC .. A47C 7/40; A47C 7/44; A47C 7/441; A47C 7/446
See application file for complete search history.

(56) References Cited

U.S. PATENT DOCUMENTS 4,200,332 A * 4/1980 Brauning ..... A47C 1/03266 297/316
4,270,797 A * 6/1981 Brauning ..... A47C 1/03272 297/316
4,408,800 A * 10/1983 Knapp ..... A47C 1/03283 297/285
4,432,582 A * 2/1984 Wiesmann ..... A47C 1/03255 297/316
4,471,994 A * 9/1984 Zund ..... A47C 1/03216 297/316
4,537,445 A * 8/1985 Neuhoff ..... A47C 1/03255 297/300.8
4,981,326 A * 1/1991 Heidmann ..... A47C 7/441 297/285
5,069,496 A * 12/1991 Kunh ..... A47C 7/446 297/301.7
6,234,573 B1 * 5/2001 Roder ..... A47C 1/03272 297/300.5
10,172,462 B2 * 1/2019 Skog ..... A47C 1/03255

* cited by examiner

*Primary Examiner* — F Griffin Hall
(74) *Attorney, Agent, or Firm* — Birchwood IP

(57) ABSTRACT

A chair with an adjustable back depth includes a chassis, a seat plate, a back plate, a hinge seat, a pneumatic rod, a trigger piece, a drive piece, a support seat frame, rocking bars. The hinge seat includes a hinge cavity and a rod channel. The hinge seat is arranged in the accommodating cavity. An inner side of a lower end is hinged to a rear hinge hole of the support plate. A lower hinge plate of the rocking bar is hinged to a front hinge hole of the support plate. A main body of the pneumatic rod is hinged to the bottom hinge cavity. The trigger piece is hinged to the hinge seat and cooperates The drive piece is arranged on the chassis An adjustment device consists of the hinge seat, which has a simple structure, convenience in assembly, realize the adjustment of the depth of the back.

6 Claims, 7 Drawing Sheets

CHAIR WITH ADJUSTABLE BACK DEPTH

CROSS-REFERENCE TO RELATED APPLICATIONS

This is a U.S. patent application which claims the priority and benefit of Chinese Patent Application Number 202310983403.1, filed on Aug. 4, 2023, the disclosure of which is incorporated herein by reference in its entirety.

TECHNICAL FIELD

The present disclosure relates to a chair

BACKGROUND

At present, in the conventional art, a seat chassis with a tilting force adjustment device includes a seat shell and a tilting force adjustment device. The tilting force adjustment device includes elastic pressing blocks, an elastic piece, a rotating shaft, a circlip, a sliding block, a screw, a pinion, an adjustment rod, a bull wheel, and a backrest connecting piece. The seat shell and the backrest connecting piece are fixed by the circlip after being connected through the rotating shaft; the elastic pressing blocks are respectively fixed to two ends of the elastic piece; and both ends of the elastic piece are respectively connected to the seat shell and the backrest connecting piece. The present disclosure designs a chassis with a tilting function through a lever principle, and meanwhile, a tilting force is adjusted by adjusting an endpoint preload, which enables a backrest of an office chair to have a tilting function. A problem is that only a tilting angle of the backrest can be adjusted.

SUMMARY

An objective of the present disclosure is to provide a chair with an adjustable back depth, which has the characteristics of simple structure and adjustable back depth.

The present disclosure is implemented as follows: a chair with an adjustable back depth includes a chassis, a seat plate, a back plate, a hinge seat, a pneumatic rod, a trigger piece, a drive piece, a support seat frame, and rocking bars.

The chassis includes an accommodating cavity and two support plates arranged at a rear end.

The hinge seat includes a hinge cavity and a rod channel communicated with the hinge cavity.

The support seat frame includes a bottom hinge cavity and two frame poles. The frame pole is hollow, has a front opening, and is communicated with the bottom hinge cavity.

The rocking bar is arranged between an upper hinge plate and a lower hinge plate. A connecting seat is arranged on a rear surface of a back plate. The connecting seat has two hinge grooves with rear openings and lower openings.

The seat plate is fixed to the chassis. The hinge seat is arranged in the accommodating cavity. An inner side of a lower end of the frame pole is hinged to a rear hinge hole of the support plate. A lower hinge plate of the rocking bar is hinged to a front hinge hole of the support plate. The rocking bar is embedded into the frame pole. An outer side of an upper end of the frame pole is hinged to a rear end of a hinge groove. An upper hinge plate is hinged to a front end of the hinge groove. A main body of the pneumatic rod is hinged to the bottom hinge cavity. A piston rod is hinged to the hinge cavity. The trigger piece is hinged to the hinge seat and cooperates with an execution push rod of the pneumatic rod. The drive piece is arranged on the chassis and cooperates with the trigger piece.

The chair with an adjustable back depth is characterized in that: the trigger piece includes a transverse trigger plate, two side plates, and a hinge frame plate. A drive plate is arranged on one side plate.

The hinge frame plate is hinged to two sides of the hinge seat; the transverse trigger plate cooperates with the execution push rod; and the drive piece cooperates with the drive plate.

The chair with an adjustable back depth is characterized in that: a rotating cavity and a movable hole are formed in the chassis.

The drive piece includes a rotating body part, a shaft head, a pressing plate, and a handle.

The rotating body part is arranged in the rotating cavity; the shaft head is pivoted with two ends of the rotating cavity; the pressing plate extends into the accommodating cavity and cooperates with the drive plate; and the handle extends out from the movable hole.

The chair with an adjustable back depth is characterized in that: the rotating body part is provided with a limiting plate; and the limiting plate cooperates with a wall plate of the rotating cavity to stop.

The chair with an adjustable back depth is characterized in that: a raised head is arranged in a central part of the transverse trigger plate of the trigger piece; and the raised head extends into the hinge cavity and cooperates with the execution push rod.

The chair with an adjustable back depth is characterized in that: rotating holes are formed in two side wall plates of the hinge cavity of the hinge seat.

The chair further includes a frame plate and a rotating piece.

The piston rod of the pneumatic rod is fixed to the central part of the frame plate; the rotating piece is rotatably matched with the rotating holes; and the frame plate is fixed to the rotating piece.

According to the chair with an adjustable back depth, an adjustment device consists of the hinge seat, the pneumatic rod, the trigger piece, and the drive piece, which has a simple structure, convenience in assembly, and a fast action, and realize the adjustment of the depth of the back.

DETAILED DESCRIPTION

Figure 1:
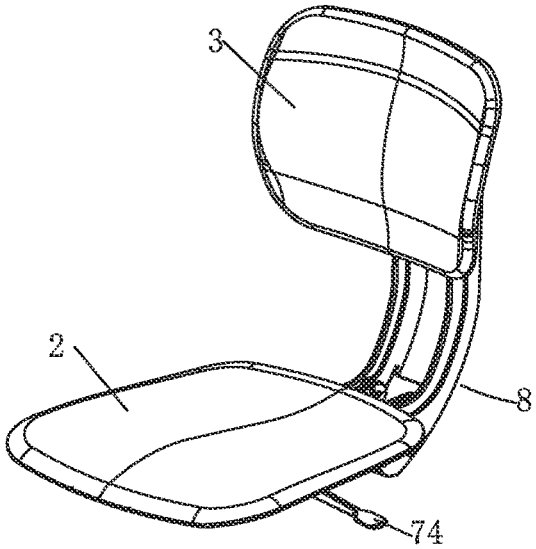
FIG. 1 is a three-dimensional diagram of the present disclosure.

The embodiments of the present disclosure are described in detail below, and the examples of the embodiments are illustrated in the drawings, where identical or similar reference signs throughout represent identical or similar elements or elements with identical or similar functions. The embodiments described below with reference to the drawings are exemplary, which are only intended to explain the present disclosure and cannot be construed as a limitation on the present disclosure.

In the descriptions of the present disclosure, it is to be noted that, unless otherwise specified and defined explicitly, the terms "mounted", "interconnected", and "connected" are to be interpreted broadly, for example, may be fixedly connected, detachably connected, or integrally connected, or may be directly connected, indirectly connected through an intermediate, or internally communicated between two elements. Those of ordinary skill in the art may understand specific meanings of the above terms in the present disclosure in specific cases.

As shown in FIG. 1, a chair with an adjustable back depth includes a chassis 1, a seat plate 2, a back plate 3, a hinge seat 4, a pneumatic rod 5, a trigger piece 6, a drive piece 7, a support seat frame 8, and rocking pieces 9.

The chassis 1 includes an accommodating cavity 1A and two support plates 1B arranged at a rear end.

The hinge seat 4 includes a hinge cavity 41 and a rod channel 42 communicated with the hinge cavity. The rod channel 42 has a lower opening.

The support seat frame 8 includes a bottom hinge cavity 81 and two frame poles 82. The frame pole 82 is hollow, has a front opening, and is communicated with the bottom hinge cavity 81.

The rocking piece 9 is arranged between an upper hinge plate 91 and a lower hinge plate 92. The rocking piece 9 is integrally formed.

A connecting seat 31 is arranged on a rear surface of a back plate 3. The connecting seat 31 has two hinge grooves 32 with rear openings and lower openings.

The seat plate 2 is fixed to the chassis 1. The hinge seat 4 is arranged in the accommodating cavity 1A and is fixed. An inner side of a lower end of the frame pole 82 is hinged to a rear hinge hole 1B1 of the support plate 1B. A lower hinge plate 92 of the rocking piece 9 is hinged to a front hinge hole 1B2 of the support plate 1B. The rocking piece 9 is embedded into the frame pole 82. An outer side of an upper end of the frame pole 82 is hinged to a rear end of a hinge groove 32. An upper hinge plate 91 is hinged to a front end of the hinge groove 32. A main body 51 of the pneumatic rod 5 is hinged to the bottom hinge cavity 81. A piston rod 52 is hinged to the hinge cavity 41. The trigger piece 6 is hinged to the hinge seat 4 and cooperates with an execution push rod 53 of the pneumatic rod 5. The drive piece 7 is arranged on the chassis 1 and cooperates with the trigger piece 6.

As a further improvement of the present disclosure, the trigger piece 6 includes a transverse trigger plate 61, two side plates 62, and a hinge frame plate 63. A drive plate 64 is arranged on an end of one side plate.

A lower end of the hinge frame plate 63 is hinged to two sides of the hinge seat 4. The transverse trigger plate 61 cooperates with the execution push rod 53. The drive piece 7 cooperates with the drive plate 64.

As a further improvement of the present disclosure, a rotating cavity 1C and a movable hole 1D are formed in the chassis 1.

The drive piece 7 includes a rotating body part 71, a shaft head 72, a pressing plate 73, and a handle 74.

The rotating body part 71 is arranged in the rotating cavity 1C. The shaft head 72 is pivoted with two ends of the rotating cavity 1C. The pressing plate 73 extends into the accommodating cavity 1A and cooperates with the drive plate 64. The handle 74 extends out from the movable hole 1D.

As a further improvement of the present disclosure, the rotating body part 71 is provided with a limiting plate 75; and the limiting plate 75 cooperates with a wall plate of the rotating cavity 1C to stop.

As a further improvement of the present disclosure, a raised head 611 is arranged in a central part of the transverse trigger plate 61 of the trigger piece 6; and the raised head 611 extends into the hinge cavity 41 and cooperates with the execution push rod 53.

As a further improvement of the present disclosure, rotating holes 411 are formed in two side wall plates of the hinge cavity 41 of the hinge seat 4.

The chair further includes a frame plate 10 and a rotating piece 11.

The piston rod 52 of the pneumatic rod 5 is fixed to the central part of the frame plate 10; the rotating piece 11 is rotatably matched with the rotating holes 411; and the frame plate 10 is fixed to the rotating piece 11.

Figure 2:
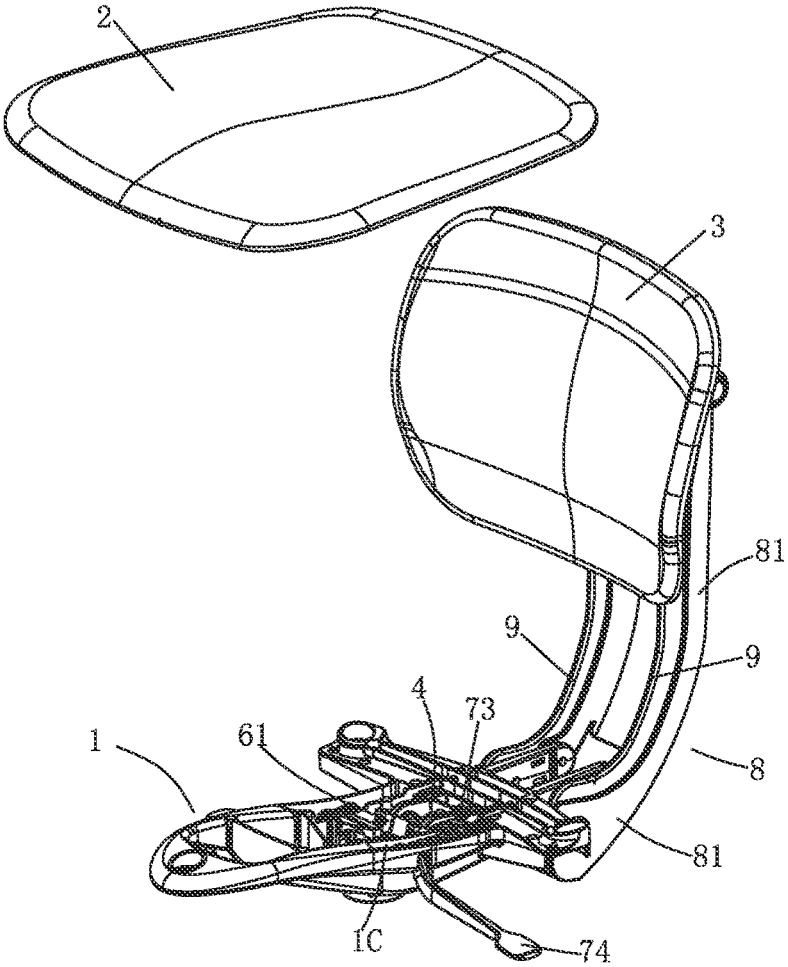
FIG. 2 is a first three-dimensional decomposition diagram of the present disclosure.
Figure 3:
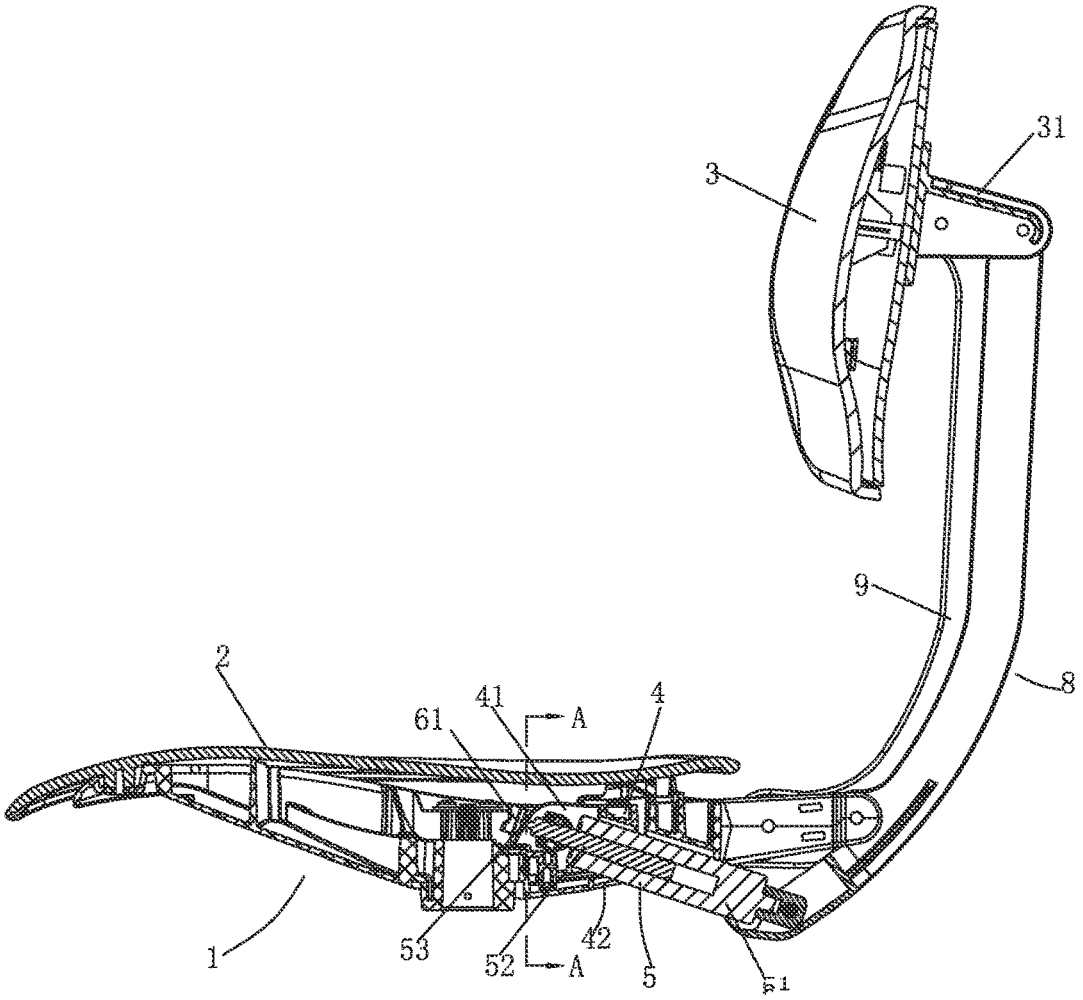
FIG. 3 is a sectional view of the present disclosure.
Figure 4:
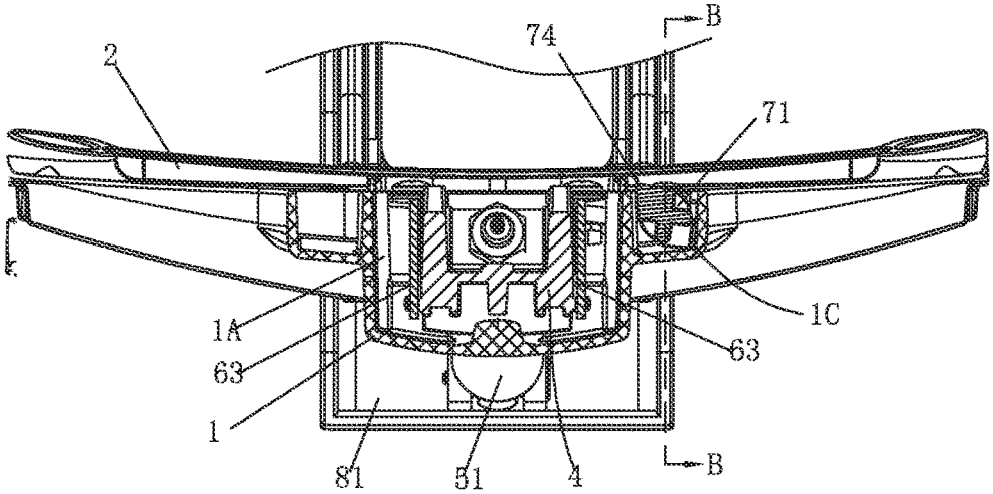
FIG. 4 is an A-A view of FIG. 3.
Figure 5:
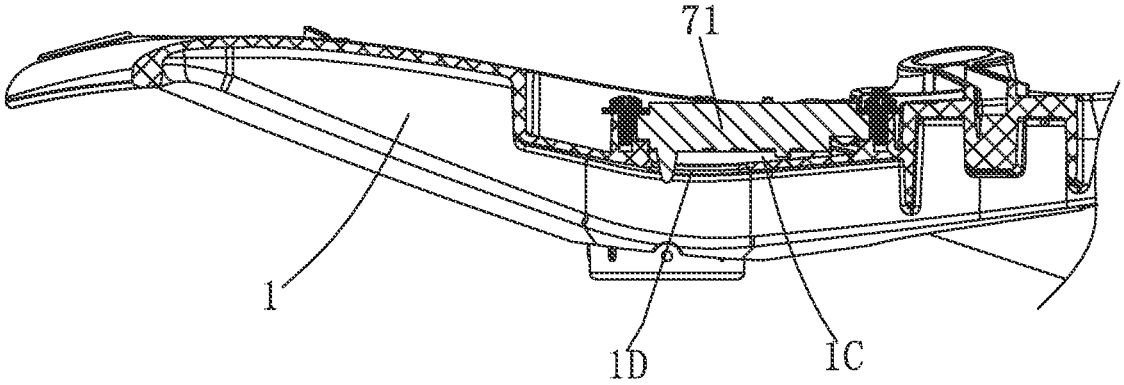
FIG. 5 is a B-B view of FIG. 4.
Figure 6:
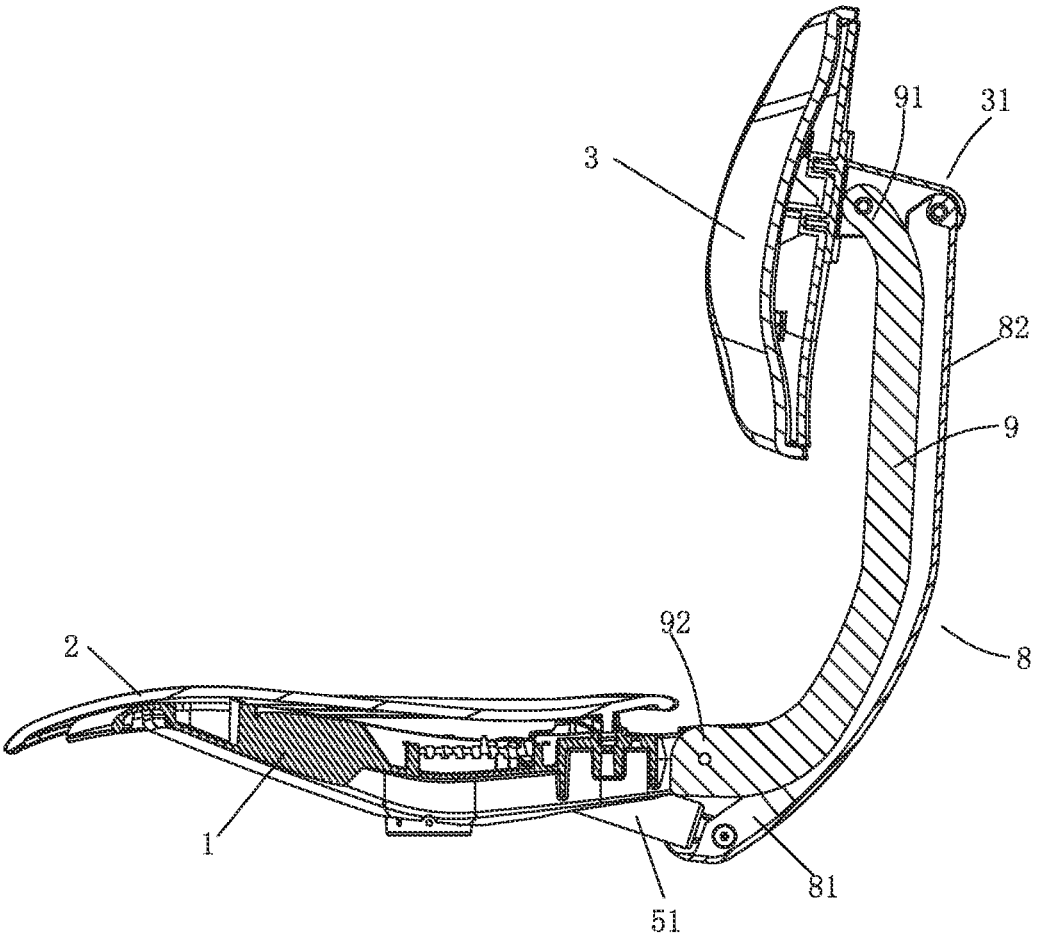
FIG. 6 is a second sectional view of the present disclosure.
Figure 7:
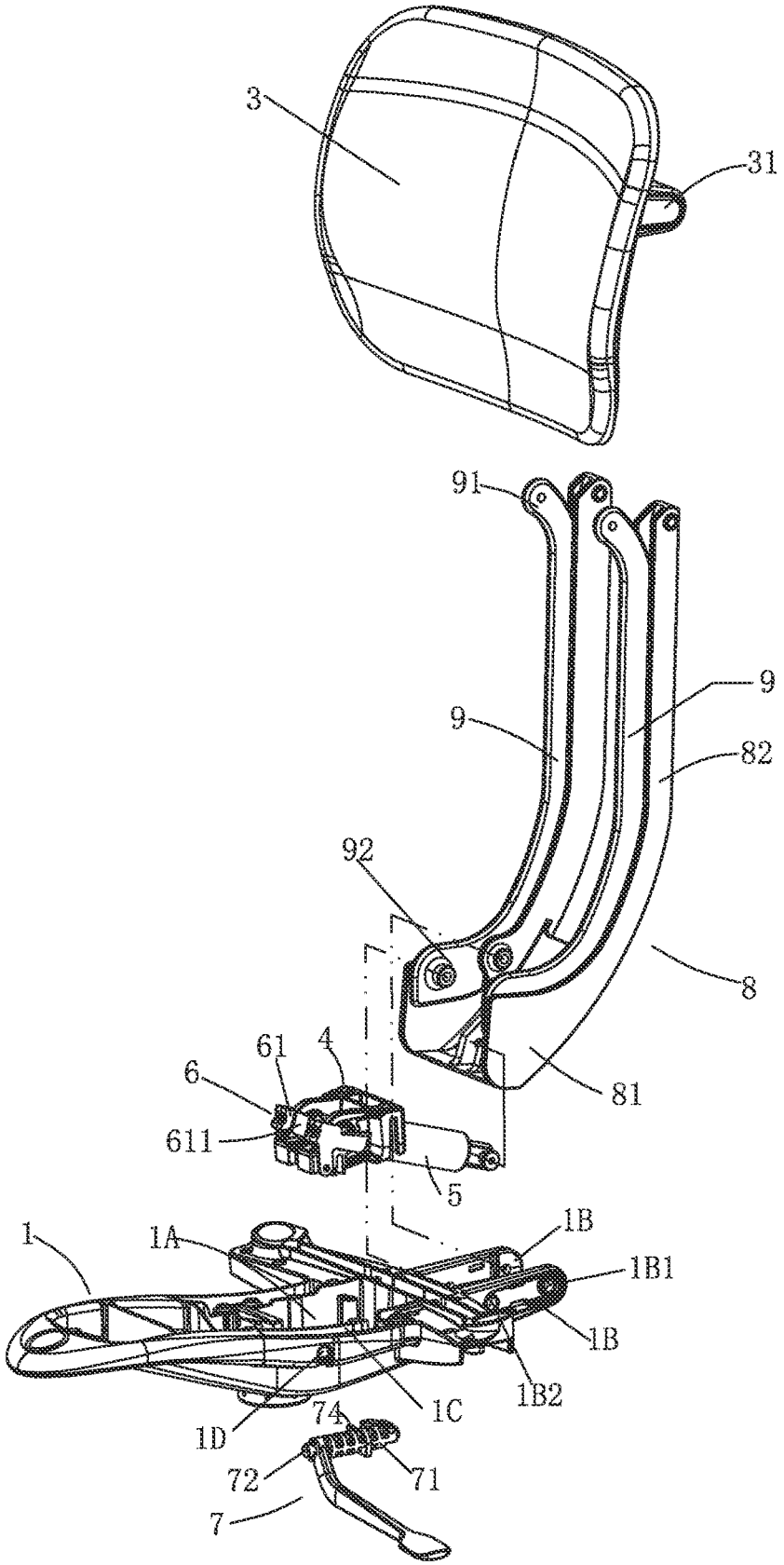
FIG. 7 is a second three-dimensional decomposition diagram of the present disclosure.
Figure 8:
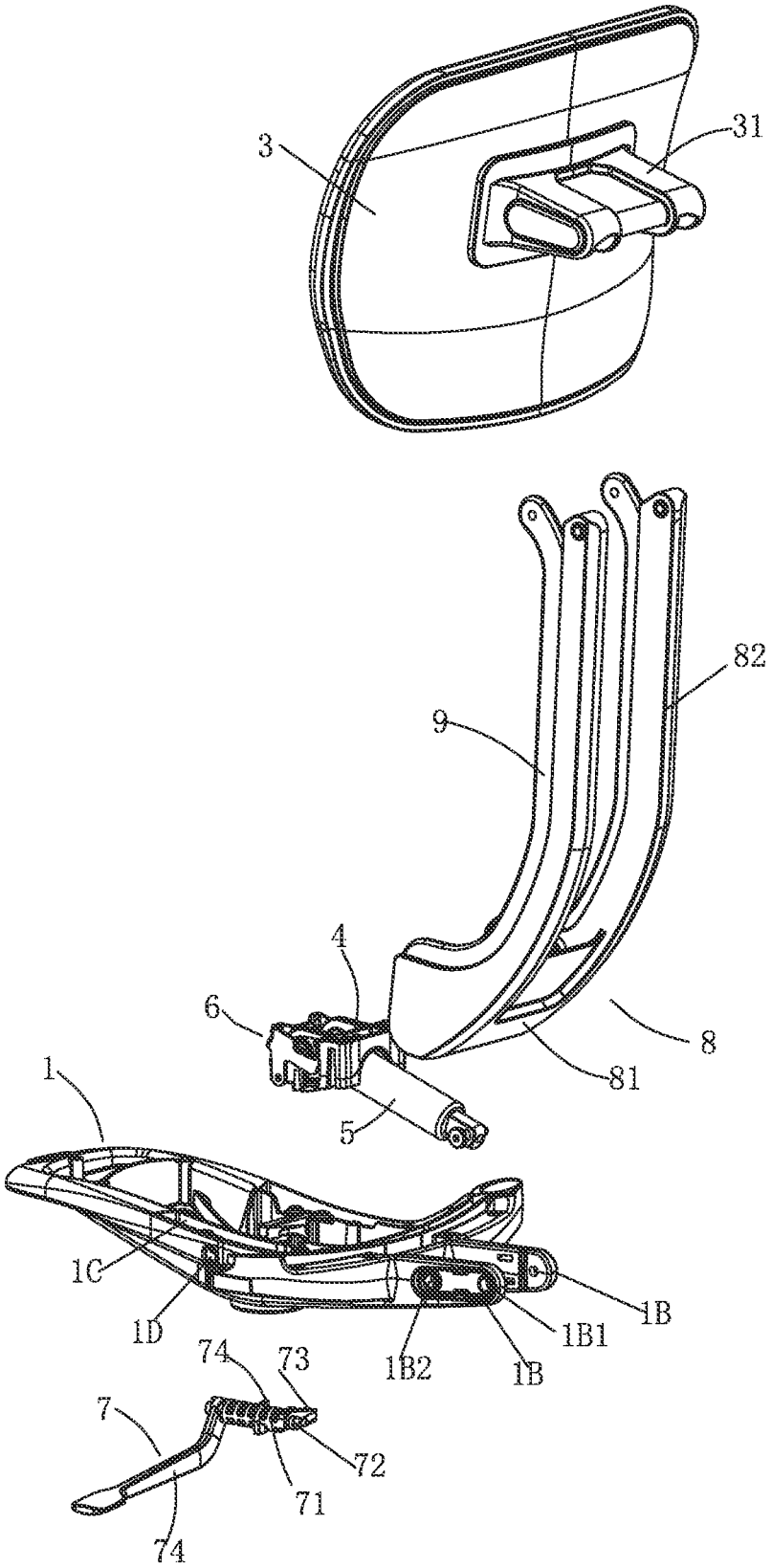
FIG. 8 is a third three-dimensional decomposition diagram of the present disclosure.
Figure 9:
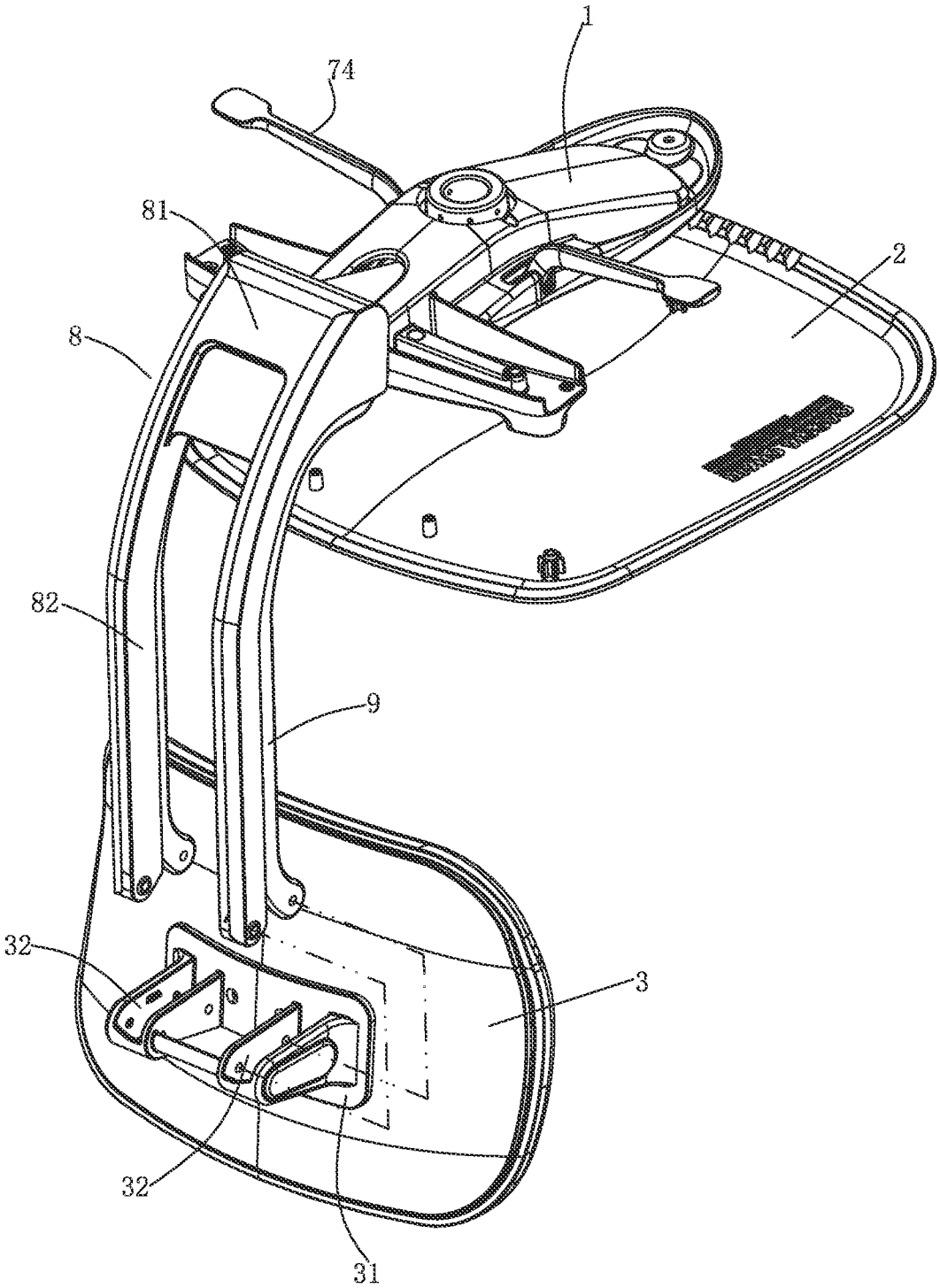
FIG. 9 is a fourth three-dimensional decomposition diagram of the present disclosure.
Figure 10:
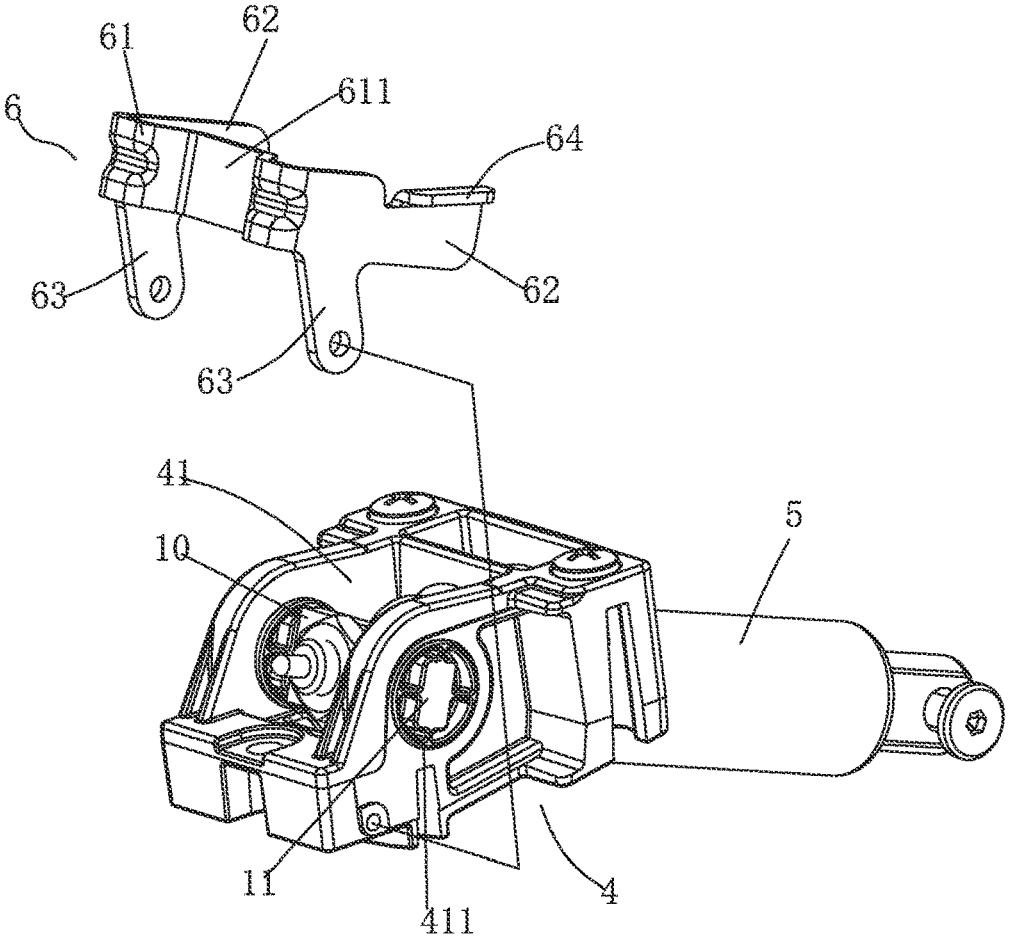
FIG. 10 is a three-dimensional decomposition diagram of the cooperation of the hinge seat, the pneumatic rod, and the trigger piece of the present disclosure.
Figure 11:
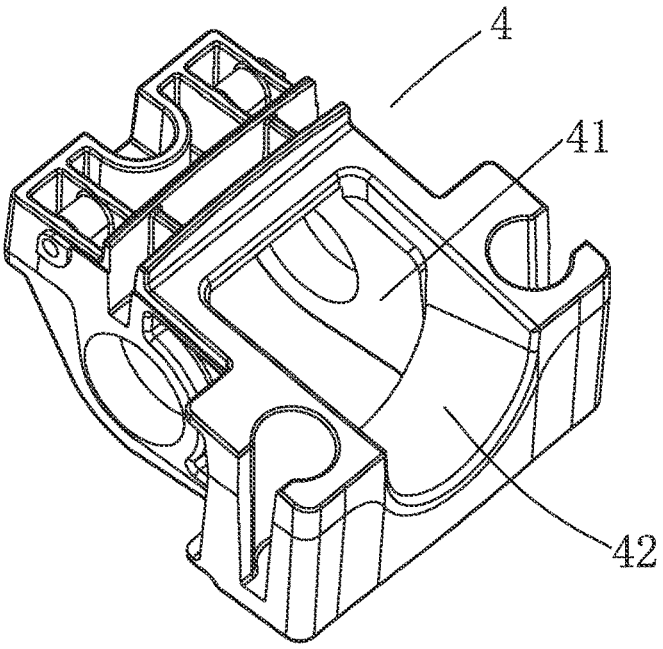
FIG. 11 is a three-dimensional diagram of the hinge seat of the present disclosure.

When the present disclosure is used, in states of FIG. 1 and FIG. 2, the handle 74 is lifted up, the rotating body part 7 rotates anticlockwise in the rotating cavity 1C, as shown in FIG. 4. The pressing plate 73 downward presses the drive plate 64 of the trigger piece 6, and the trigger piece 6 rotates clockwise in FIG. 3 and FIG. 7.

The transverse trigger plate 61 triggers the execution part 53 of the pneumatic rod 5, the pneumatic rod 6 enables the support seat frame 8 to rotate, and the rocking bar 9 rotates accordingly to adjust the depth of the back plate.

In a state shown in FIG. 3, assuming that the piston rod extends out, the support seat frame 8 rotates anticlockwise. Meanwhile, the rocking bar 9 swings to the left side to realize leftward movement of the back plate 3.

In the state of FIG. 3, assuming that the piston rod retracts, the support seat frame 8 rotates clockwise. Meanwhile, the rocking bar 9 swings to the right side to realize rightward movement of the back plate 3.

Although the embodiments of the present disclosure have been shown and described, those of ordinary skill in the art can understand that a variety of changes, modifications, substitutions, and variants can be made to these embodiments without departing from the principle and purpose of the present disclosure, and the scope of the present disclosure is defined by the claims and their equivalents.

What is claimed is:

1. A chair with an adjustable back depth, comprising a chassis, a seat plate, a back plate, a hinge seat, a pneumatic rod, a trigger piece, a drive piece, a support seat frame, and rocking bars, wherein the chassis comprises an accommodating cavity and two support plates arranged at a rear end;

the hinge seat comprises a hinge cavity and a rod channel communicated with the hinge cavity;

the support seat frame comprises a bottom hinge cavity and two frame poles, and the two frame poles are hollow, have a front opening, and are communicated with the bottom hinge cavity;

the rocking bars are arranged between an upper hinge plate and a lower hinge plate; a connecting seat is arranged on a rear surface of a back plate; the connecting seat has two hinge grooves with rear openings and lower openings;

the seat plate is fixed to the chassis; the hinge seat is arranged in the accommodating cavity; inner sides of lower ends of the two frame poles are hinged to a rear hinge hole of the two support plates; the lower hinge plate is hinged to a front hinge hole of the two support plates; the rocking bars are embedded into the two frame poles; outer sides of upper ends of the two frame poles are hinged to a rear end of one of the two hinge grooves; the upper hinge plate is hinged to a front end of one of the two hinge grooves; a main body of the pneumatic rod is hinged to the bottom hinge cavity; a piston rod is hinged to the hinge cavity; the trigger piece is hinged to the hinge seat and cooperates with an execution push rod of the pneumatic rod; and the drive piece is arranged on the chassis and cooperates with the trigger piece.

2. The chair with an adjustable back depth according to claim 1, wherein the trigger piece comprises a transverse trigger plate, two side plates, and a hinge frame plate; a drive plate is arranged on one of the two side plates;

the hinge frame plate is hinged to two sides of the hinge seat; the transverse trigger plate cooperates with the execution push rod; and the drive piece cooperates with the drive plate.

3. The chair with an adjustable back depth according to claim 2, wherein a rotating cavity and a movable hole are formed in the chassis;

the drive piece comprises a rotating body part, a shaft head, a pressing plate, and a handle;

the rotating body part is arranged in the rotating cavity; the shaft head is pivoted with two ends of the rotating cavity; the pressing plate extends into the accommodating cavity and cooperates with the drive plate; and the handle extends out from the movable hole.

4. The chair with an adjustable back depth according to claim 3, wherein the rotating body part is provided with a limiting plate; and the limiting plate cooperates with a wall plate of the rotating cavity to stop.

5. The chair with an adjustable back depth according to claim 1, wherein a raised head is arranged in a central part of the transverse trigger plate of the trigger piece; and the raised head extends into the hinge cavity and cooperates with the execution push rod.

6. The chair with an adjustable back depth according to claim 1, wherein rotating holes are formed in two side wall plates of the hinge cavity of the hinge seat;

the chair further comprises a frame plate and a rotating piece;

the piston rod of the pneumatic rod is fixed to a central part of the frame plate; the rotating piece is rotatably matched with the rotating holes; and the frame plate is fixed to the rotating piece.

* * * * *